United States Patent [19]

Ward

[11] Patent Number: 4,635,423

[45] Date of Patent: Jan. 13, 1987

[54] BUILDING INSULATION AND WALL COVERING SYSTEM AND METHOD

[76] Inventor: Lonnie R. Ward, P.O. Box 493, Lewisville, Tex. 75067

[21] Appl. No.: 657,380

[22] Filed: Oct. 3, 1984

[51] Int. Cl.[4] ..... E04B 1/74; E04B 5/52

[52] U.S. Cl. ..... 52/746; 52/404; 52/419; 52/743; 156/71

[58] Field of Search ..... 52/404, 406, 407, 743, 52/746, 478, 416, 419; 156/71

[56] References Cited

U.S. PATENT DOCUMENTS

| | | | |
|---|---|---|---|
| 2,264,976 | 12/1941 | Heritage | 52/462 |
| 2,587,985 | 3/1952 | Elmendorf | 156/71 X |
| 3,307,306 | 3/1967 | Oliver | 52/409 X |
| 3,969,863 | 7/1976 | Alderman | 52/407 |
| 4,047,345 | 9/1977 | Alderman | 52/404 |
| 4,047,346 | 9/1977 | Alderman | 52/407 |
| 4,069,636 | 1/1978 | Kessler | 52/712 |
| 4,128,984 | 12/1978 | Charbonneau | 52/478 |
| 4,151,692 | 5/1979 | Holcombe | 52/404 |
| 4,233,791 | 11/1980 | Kuhl et al. | 52/743 X |
| 4,248,021 | 2/1981 | Dyer | 52/404 |
| 4,379,381 | 4/1983 | Holcombe | 52/404 |
| 4,446,664 | 5/1984 | Harkins | 52/404 |
| 4,472,920 | 9/1984 | Simpson | 52/404 |
| 4,494,348 | 1/1985 | Kastelic | 52/462 |

FOREIGN PATENT DOCUMENTS

| | | | |
|---|---|---|---|
| 3235246 | 3/1984 | Fed. Rep. of Germany | 52/404 |
| 755974 | 8/1980 | U.S.S.R. | 52/63 |

OTHER PUBLICATIONS

Insul-Grid/Mizell Bros. Co.-copyright 1983.

*Primary Examiner*—Alfred C. Perham
*Attorney, Agent, or Firm*—Hubbard, Thurman, Turner & Tucker

[57] ABSTRACT

An interior ceiling or wall covering system comprising longitudinal parallel flexible panels formed by vapor barrier material applied to flange surfaces of ceiling joists or purlins or wall girts wherein the panels extend parallel to the longitudinal extent of the joists, purlins or girts and are secured to the flanges thereof by a pressure sensitive adhesive. Self drilling fasteners are driven into the structural member flanges at spaced apart intervals to provide backup support for securing the panels to the structural members. The enclosed space formed by the panels may be filled with loose, sprayed on or preformed batts of insulation material. The panels may be extended in directions normal to the purlins or girts by utilizing light gauge support strips to which the panels are applied with pressure sensitive adhesive and with spaced apart fasteners driven into the flanges of the structural members at points contiguous with the panels. The panels provide a lightweight aesthetically pleasing interior wall or ceiling covering closing an air space between the ceiling or wall panels and the panels themselves.

19 Claims, 7 Drawing Figures

FIG. 2
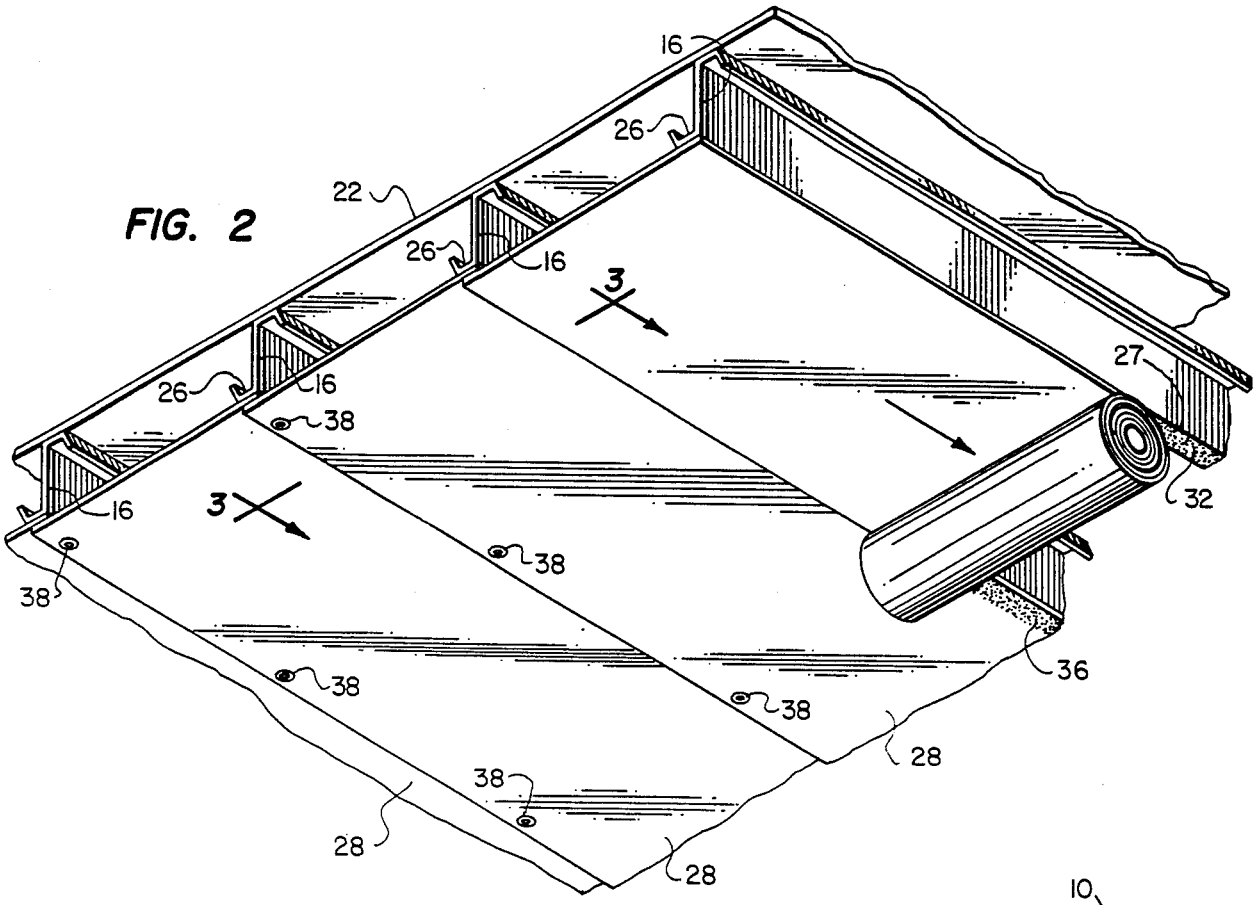
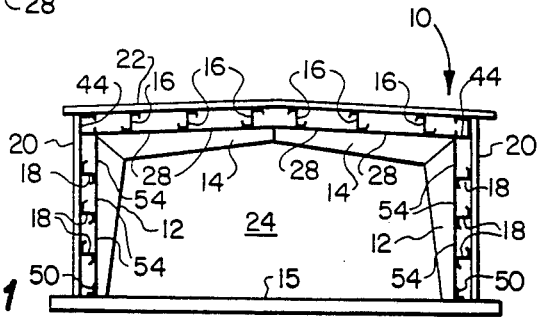
FIG. 1
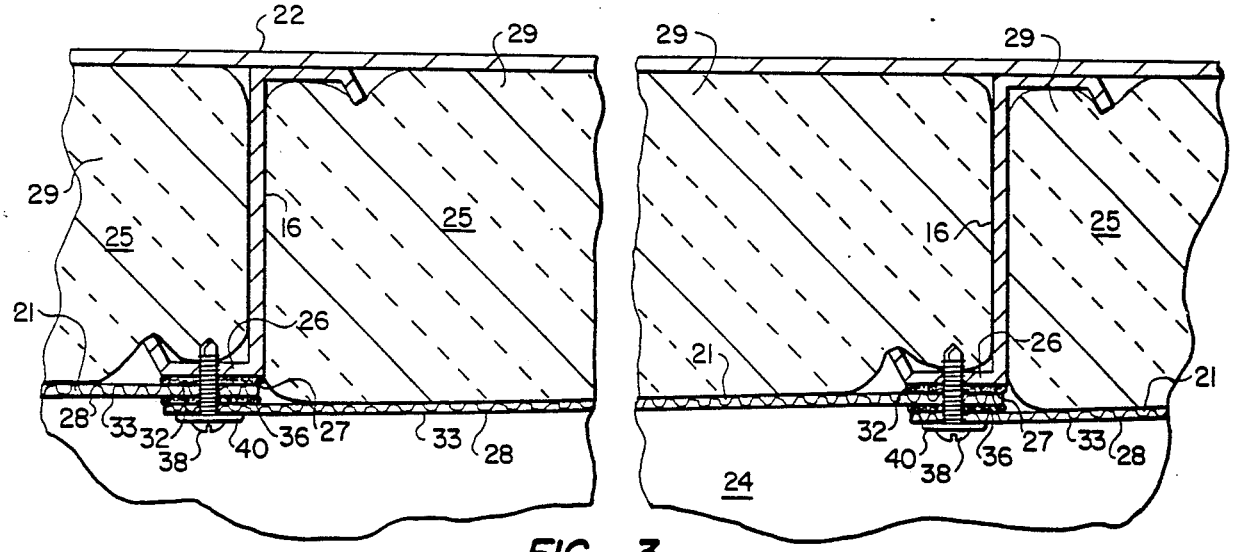
FIG. 3

BUILDING INSULATION AND WALL COVERING SYSTEM AND METHOD

BACKGROUND OF THE INVENTION

1. Field of the Invention

The present invention pertains to a ceiling and wall covering to be used in the interior of buildings having exposed roof joists or purlins and wall beams wherein a flexible rolled sheet covering is secured to the flanges of the joists or beams or to support strips supported by the joists or beams.

2. Background

There are several types of commercial buildings wherein the basic building framework comprises vertical and horizontal wall beams over which exterior wall sheeting is applied, and a roof made up of parallel joists or purlins which support various types of exterior roof surface coverings. The requirements for efficiently and cost effectively insulating buildings constructed in accordance with the general type of structure described above are particularly difficult to satisfy and also provide an aesthetically appealing and functional interior wall covering over the insulation material. Although in new building construction insulation can be added between the wall or ceiling support members and the exterior wall covering or roof decking this concept is not entirely satisfactory as it exposes a large surface area of the wall beams and roof joists as heat transfer surfaces.

Another problem associated with conventional insulation installation methods results from improperly sealed points between adjacent batts wherein an inadequate vapor seal is formed. Moreover, in conventional insulation installation techniqus compression of the insulation blanket or batt at joints and using conventional fastening methods causes as much as a 40% loss in insulating value.

In buildings wherein insulation is installed after the building is constructed various special fasteners and support members are required to secure the insulation material in place. These support systems and methods are expensive and their use is restricted due to existing building frame members and other structures such as air ducts and piping or electrical conduits.

Accordingly, it is highly desirable to provide a lightweight insulation support and covering system which extends between and covers the purlins or joists as well as the wall beams to improve insulation installation and to minimize heat transfer between the interior and exterior of the structure. Moreover, the increased ambient vapor pressure in a building interior caused by the presence of insulation makes it particularly desirable to have a vapor seal on the inside surface to retard the flow of water vapor into the insulation or adjacent building frame members where condensation may occur.

Various types of insulation materials can, of course, be applied such as spray-on insulation coatings for the interior surfaces of the wall and ceiling coverings as well as the structural support members. Other types of insulation materials such as fiberglass batts, boards or blankets and spray on or loose fill insulation such as fiberglass, cellulose, rockwool and other materials may be used. However, most of these materials, when applied from the interior of the building are unsightly, are difficult to secure to or between the structural members and provide a suitable vapor seal and are subject to accumulations of dirt, moisture and to breaking up to fall into the building interior. It is to this end that an improved insulation covering system and support system including an interior wall covering and a method of application therefor has been developed in accordance with the present invention as will be appreciated by those skilled in the art.

SUMMARY OF THE INVENTION

The present invention provides an improved building interior insulation support and wall covering system wherein the spaces between roof joists or purlins as well as the space between wall beams or columns may be utilized to retain insulation material and wherein a low cost interior wall covering is provided to contain, support and isolate the insulation material with respect to the interior of the building.

In accordance with an important aspect of the present invention there is provided a building interior wall covering system which utilizes a flexible wall covering material provided in rolled sheet form or the like and which is secured to ceiling joists or purlins as well as interior wall beams or girts by a combination of adhesive and inexpensive mechanical fasteners and wherein the wall covering may be applied by unrolling the covering material from continuous rolls of indeterminate or predetermined length directly in engagement with the flange surfaces of the roof joists or purlins and wall girts or beams. The wall covering material is preferably formed of a flexible reinforced plastic coated paper wherein the covering material forms a vapor retarder and is of sufficient strength to support certain types of insulation material in the spaces formed between the covering and the building structural members.

In accordance with another aspect of the present invention there is provided a building interior insulation support and retaining system wherein rolls of flexible wall covering material or liner may be applied by unrolling the material along the flanges of the roof and wall structural members in supportive relationship to the wall covering material along opposed parallel edges or, alternatively, a series of support strips may be applied to the building structural members and the wall or ceiling covering applied directly to the support strips in the same manner that it is applied to the structural members themselves.

Still further in accordance with the present invention the flexible wall and ceiling covering may be applied to an insulation strip interposed between the liner or wall covering and the flanges of the building structural members. The interior wall covering or liner may also be secured at corners or edges of the wall or ceiling by the use an adapter strip or angle member which provides a surface for fastening or adhering a marginal edge of the covering material.

In accordance with another aspect of the present invention there is provided a method for providing an interior wall covering and insulation system for buildings having exposed ceiling joists and/or exposed wall beams or girts wherein a low cost and easily installed wall covering is applied by coating the inwardly facing flanges of the ceiling joists or wall beams with an adhesive and by applying a flexible wall covering comprising a plastic or foil coated reinforced paper material directly to the joists or beams by unrolling the material from continuous rolls of predetermined length and having precut marginal lateral edges of predetermined dimensions. The wall covering is preferably installed in parallel strips which overlap each other approximately the width of the ceiling joist or wall beam flanges and wherein the strips are adhered to the joist or beam flanges with a pressure sensitive adhesive and the securing means is reinforced at a spaced apart intervals by the utilization of self drilling fasteners and load distributing washers.

Those skilled in the art will recognize that the improved wall covering system and method of the present invention provides a building wall covering which is economical, easy to install by a one person or two person work crew and provides support and isolation structure for various types of insulation materials which may be installed between the ceiling or wall structural members and the exterior roof decking or wall covering material. The improved covering system eliminates problems associated with vapor leakage in prior art insulation coverings and allows the use of inexpensive insulation materials which do not require lamination to a vapor retarder liner and the loss of insulating properties resulting therefrom. The covering system also adds structural strength to building framework sufficient to reduce or eliminate the use of sag rods and wind bracing or strapping between frame members and to eliminate reinforcements to prevent purlin roll.

Those skilled in the art will recognize the above mentioned features and advantages of the present invention as well as additional superior aspects thereof upon reading the detailed description which follows in conjunction with the drawing.

BRIEF DESCRIPTION OF THE DRAWING

FIG. 1 is a transverse elevation, in section, of a typical structural metal or wood exposed beam building;

FIG. 2 is a perspective view of a section of roof structure showing application of a portion of the insulation and wall covering system of the present invention;

FIG. 3 is a detail transverse section view on a larger scale than FIG. 1 and taken along line 3—3 of FIG. 2;

DESCRIPTION OF THE PREFERRED EMBODIMENTS

Figure 4:
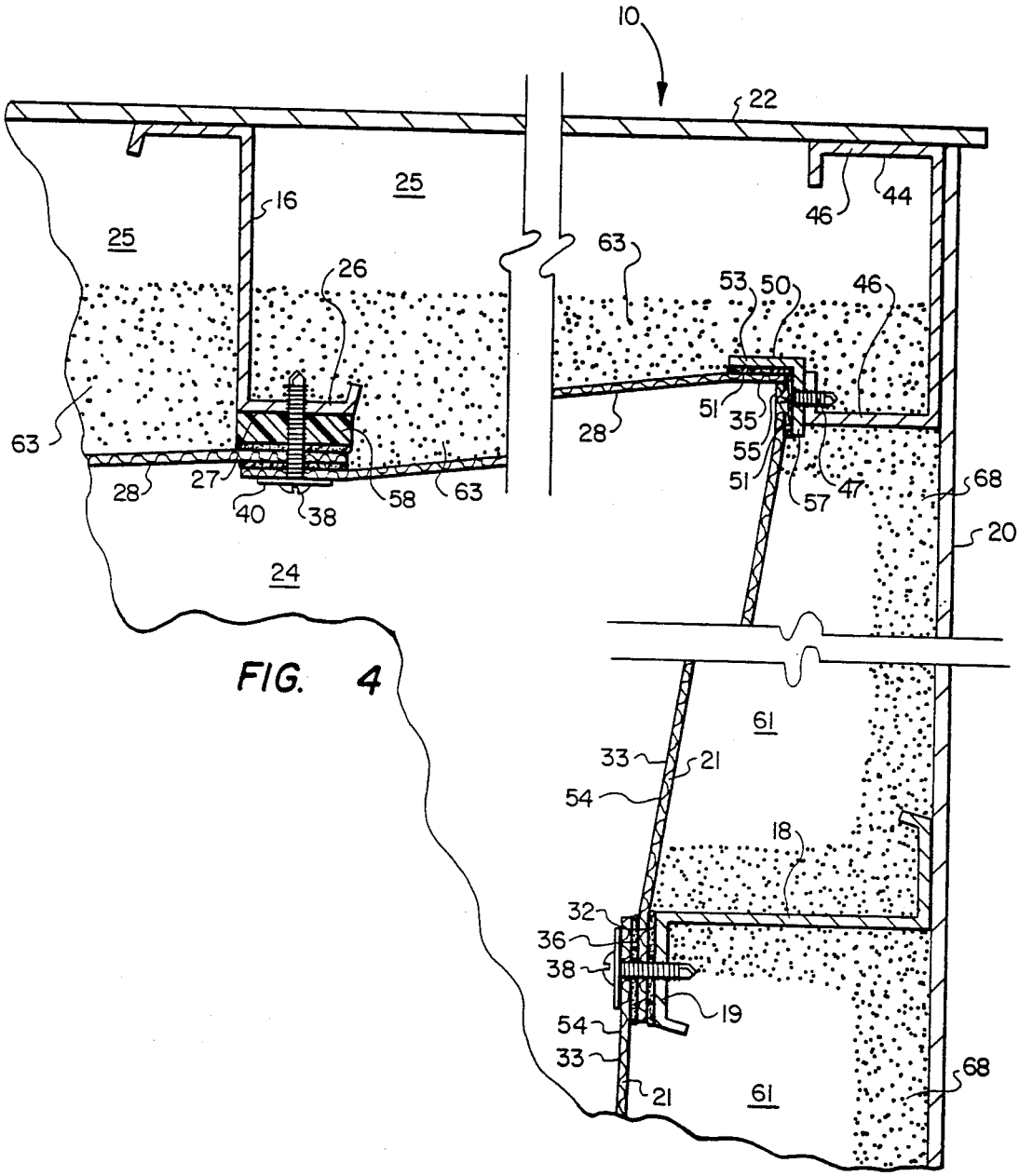
FIG. 4 is a detail elevation, in section, of the insulation and wall covering system showing the attachment at a marginal edge of the roof covering and the wall covering portions.

In the description which follows like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Referring to FIG. 1, there is illustrated in transverse section an elevation of a typical structural steel or wood framed building 10 having conventional vertical wall columns 12 and ceiling beams 14. Parallel joists and spaced apart or purlins 16 form part of the roof structure and parallel beams or girts 18 form part of the vertical wall structure or frame of the building 10. Exterior wall paneling 20 and roof decking 22 of conventional construction forms the building enclosure to provide an interior space 24. The detail of the building 10 illustrated in FIG. 1 is primarily exemplary as will be appreciated by those skilled in the art.

The framework and the spaces between frame members of buildings such as the building 10 requires insulation if the interior is to be heated or cooled to maintain an acceptable temperature level for occupancy or storage of certain goods. To this end it is conventional to spray coat the surfaces of the joists or purlins 16, the girts 18 and the interior surfaces of the paneling 20 or decking 22 with spray on type cellulose or rockwool insulation. There are also several techniques for supporting insulation material in the form of batts or blankets between the purlins 16 and the girts 18. In this regard the exposure of the insulation material to the interior 24 is often aesthetically unappealing and may result in degradation of the insulation and corrosion of the metal structure over a period of time. Normal use and aging of a building such as the building 10 will also typically result in the sprayed on type of insulation to fall into the interior 24 which, of course, is unwanted.

The present invention contemplates a system for forming an interior wall and ceiling covering of a building such as the building 10 wherein the spaces between the decking or paneling and the inner distal end surfaces of the structural members 12, 14, 16 and 18, FIG. 1, is enclosed and an attractive ceiling and wall covering is provided for the interior of the building.

As shown in FIG. 3 the purlins 16 each have generally planar flange portions 26 forming inner distal surfaces 27 of the roof support beam structure. The flange portions 26 are, of course, substantially parallel to each other and generally evenly spaced apart in accordance with the spacing of the purlins 16. For purposes of discussion herein it will be assumed that the terms joists, beams or purlins are interchangeable as regards the structural members making up the roof frame. Similar types of members are used as horizontally extending and sometimes vertically extending wall structural members such as indicated by the girts 18 in FIG. 1.

In accordance with the present invention the interior space 24 is lined or provided with wall and ceiling coverings comprising elongated parallel strips or panels 28 of flexible liner or covering material as indicated in FIGS. 2 and 3. The covering material may be selected from one of certain types of vapor barrier material normally used as an exterior covering between insulation and an exterior facade or panel. A suitable material in accordance with the present invention is a vapor barrier sheet or liner material 21, FIG. 3, manufactured by Compac Corporation, Netcong, N.J. as their type MB2003 vapor barrier. The material 21 is a reinforced No. 30 natural kraft paper with a 1.5 mil white metallized polypropylene film 33 applied to what is oriented as the inner surface facing the interior 24. Other types of covering material including combinations of metal foil, and reinforced kraft paper or combinations of plastic such as vinyl and polyester together with a reinforcement of woven or crossed threads may also be utilized.

The covering material 21 is preferably provided in rolls, such as the roll 30 illustrated in FIG. 2, which are preferably prefabricated of predetermined length and width to facilitate application to the flange surfaces 27 by first coating the surfaces with a pressure sensitive adhesive. A suitable adhesive may comprise a water based pressure sensitive adhesive such as a type 57-3005 manufactured by United Resin Products Inc., Lewisville, Tex. The adhesive may be applied directly to the planar flange surfaces 27 of adjacent purlins 16 and the panels 28 applied directly to the adhesive by aligning the roll 30 and unrolling the material in the direction of the longitudinal extent of the purlins 16. Accordingly, the flange surfaces 27 are coated with a layer 32, FIG. 3, of pressure sensitive adhesive and the panels 28 applied directly to the flange surfaces.

The covering material 21 is preferably provided in rolls 30 which are of sufficient width to span the space between adjacent purlins 16 and also cover at least a major portion of the lateral extent of the flange surfaces 27 of said adjacent purlins. Accordingly, as shown in FIG. 3, adjacent strips or panels 28 of covering material or liner overlap each other and are adhered to each other by additional layers of adhesive 36. The panels 28 are also preferably secured to the purlins 16 by self-drilling threaded fasteners 38 which are provided with load distributing washers 40. The fasteners 38 may be applied along the longitudinal extent of the flanges 26 of the purlins 16 at 2.0 ft. to 3.0 ft. intervals.

Referring now to FIG. 4, there is illustrated a preferred manner in which a marginal edge 35 of a panel 28 is secured near a vertical wall of the building 10. Typically, a structural steel building such as the building 10 will have an eave strut 44, see FIG. 1 also, extending along in supportive relationship to the juncture of the roof panel 22 with the vertical wall panel 20. The strut 44 is typically a "C" section type channel having opposed flanges 46. In such instances a marginal edge 35 of a panel 28 adjacent to the eave strut 44 may be secured to an elongated support member 50 comprising an angle section structural steel or aluminum member suitably secured to one of the flanges 46 of the eave strut 44 by one or more fasteners 47, as illustrated. A layer of adhesive 51 is applied to the flange 53 of support member 50 for retention of the panel 35. Of course, if a structural member having a planar surface substantially coplanar with the flange surfaces 27 exists at the juncture between the roof and walls of the building 10 or at any openings or structural members intersecting the plane of the flange surfaces 27 the panels 28 may be adhered to such members. For example, at longitudinal ends of a panel 28 delimited by a beam 14, the panel may be adhered across a transverse marginal edge thereof directly to the beam. Alternatively, a strip similar to the angle section member 50 may be secured adjacent to any opening or structure at the point of intersection of such opening or structure with the plane of the flange surfaces 27 to secure a marginal edge of a panel 28.

As illustrated in FIG. 4, the wall covering material 21 may also be formed in strips or panels 54 similar to the panels 28 and extending between planar surfaces formed by flange portions 19 of adjacent girts 18, one shown. The uppermost marginal edge 55 of the uppermost panel 54 is also secured to one flange 57 of the angle section strip 50 by a layer of adhesive 51. The strips or panels 54 are secured to the flanges 19 by adhesive layers 32 and fasteners 38 in the same manner as the panels 28 are secured to the flanges 26 of the purlins 16. The panel members 54 may be secured at lower marginal edges to members 50, FIG. 1, at the floor 15 in the same manner as they are secured to members 50 at the struts 44. The panels 54 may be run horizontally or vertically in accordance with the type of structural member utilized as part of the wall support structure. For example, if all of the wall structural members are vertical column members 12 it is more likely that the panels 54 will be of a lateral width such as to overlap planar flange surfaces, not shown, which may be provided by the structural members 12.

FIG. 4 also illustrates a modification to the manner in which the panels 28 are secured to the flanges 26. Instead of directly adhering the panels 28 to the flange surface 27 a generally flat rectangular elongated block 58 may be adhered directly to the flange surface 26 to form additional insulating capability between the metal flange 26 and the interior space 24 for the building 10. The block 58 is preferably formed of plastic material such as extruded or expanded polystyrene. Other materials including rigid board formed of wood, perlite, isocyanurate foam or glass fiber may be used.

The substantially enclosed spaces 25, FIGS. 3 and 4, provided between the purlins 16, the roof decking 22 and the panels 28 may be provided with various types of insulation material. As illustrated in FIG. 3, glass fiber insulation batts 29 may be inserted into the spaces 25 and supported at least partially by the panels 28. On the other hand, as shown in FIG. 4, conventionally sprayed or blown in insulation material 63 such as glass fiber, cellulose, rockwool and other types of loose material may be supported at least partially by the panels 28. Moreover, the panels 28 and 54 also may be utilized to protect insulation which is secured in other ways such as by spraying insulation material 68 on the surfaces of the girts 18 as well as the other structural support members of the building 10. The panels 28 and 54 not only provide support for certain types of insulation occupying the spaces 25 and the spaces 61 between the girts 18 and the eave strut 44, but the panels also provide a vapor retarder to prevent condensation from damaging the insulation material and the building structural members.

Furthermore, the installation of the panels 28 and 54 may be carried out on already completed buildings as well as new construction and may be installed during construction or after completion of same. The panels 28 and 54 are, of course, easy to install and, depending on the color of the film 33 facing the building interior 24 reduces lighting requirements within the interior. The installation of the panels 28 and 54 totally covering and reducing exposure to the building structural members minimizes the socalled radiator fin effect of exposed building framing. The formation of the enclosed spaces 25 and 61 also reduces convection heat loss or gain, reduces the space required for heating and cooling, eliminates certain difficult painting requirements and protects the building structural members from corrosion from condensation and environmental pollutants. The installation of the panels 28 and 54 may be carried out easily utilizing only one or two man work crews and is adaptable to most building designs regardless of purlin or joists and girts spacings as well as the existence of irregular openings or obstructions in the walls or ceiling of the buildings.

In the installation of the panels 28 the rolls 30 are normally provided in predetermined widths corresponding to the spacing between purlins 16 or girts 18 including the lateral width of the flanges 26 or 19. A layer of adhesive 32 is applied directly to the surfaces 27 of the purlin flange portions 26 or the girt flanges 19 of at least two adjacent purlins or girts and a roll 30 is oriented relative to the flanges and unrolling commenced to apply a panel 28 directly to the surfaces 27. After a panel 28 is applied to the parallel purlins 16 and unrolled to an end of the purlin or to a longitudinal end of a panel the material may be easily cut and adhered to a flange or other support surface, not shown, of a primary building frame member such as beams 12 and 14. Alternatively, a support strip such as the angle section 50 may be used to secure one or both ends of the panel or a relatively thin flat strip of a type used with an alternate embodiment described hereinbelow or a similar support member. An adhesive layer 36 is then applied over the surface of the panel 28 which has been attached to the roof support members at least coextensive with the surface 27 of the flange 26 and to a surface 27 of an adjacent purlin flange. A second panel 28 is then formed by unrolling a roll 30 of the covering material 21 extending parallel to the first panel 28. This process is repeated until the entire roof covering is completed. The formation of a panel 28 by the unrolling of the covering material 21 may be ceased at any particular time to permit installation of insulation materials such as fiberglass batts or loose fill insulation once the adhesive has set up sufficiently to support the weight of the panel 28 and any insulation material supported thereby. The fasteners 38 or explosive drivers (powder actuated) pins may then be installed at predetermined spaced intervals, as illustrated in FIG. 2, to further secure the panels 28 in place.

Figure 6:
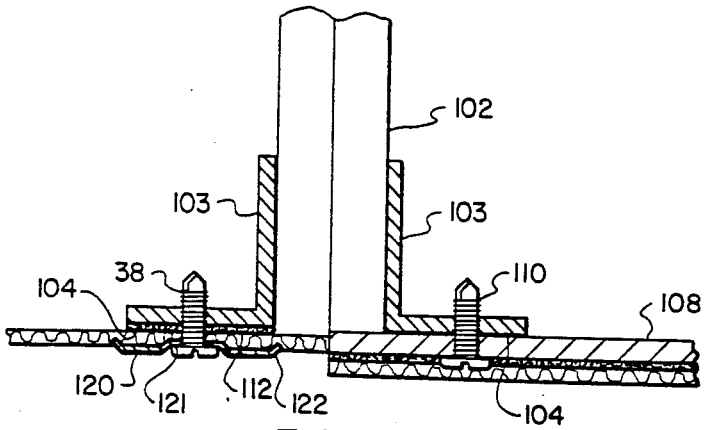
FIG. 6 is a detail section view of the system shown in FIG. 5 and taken along line 6—6 of FIG. 5.
Figure 5:
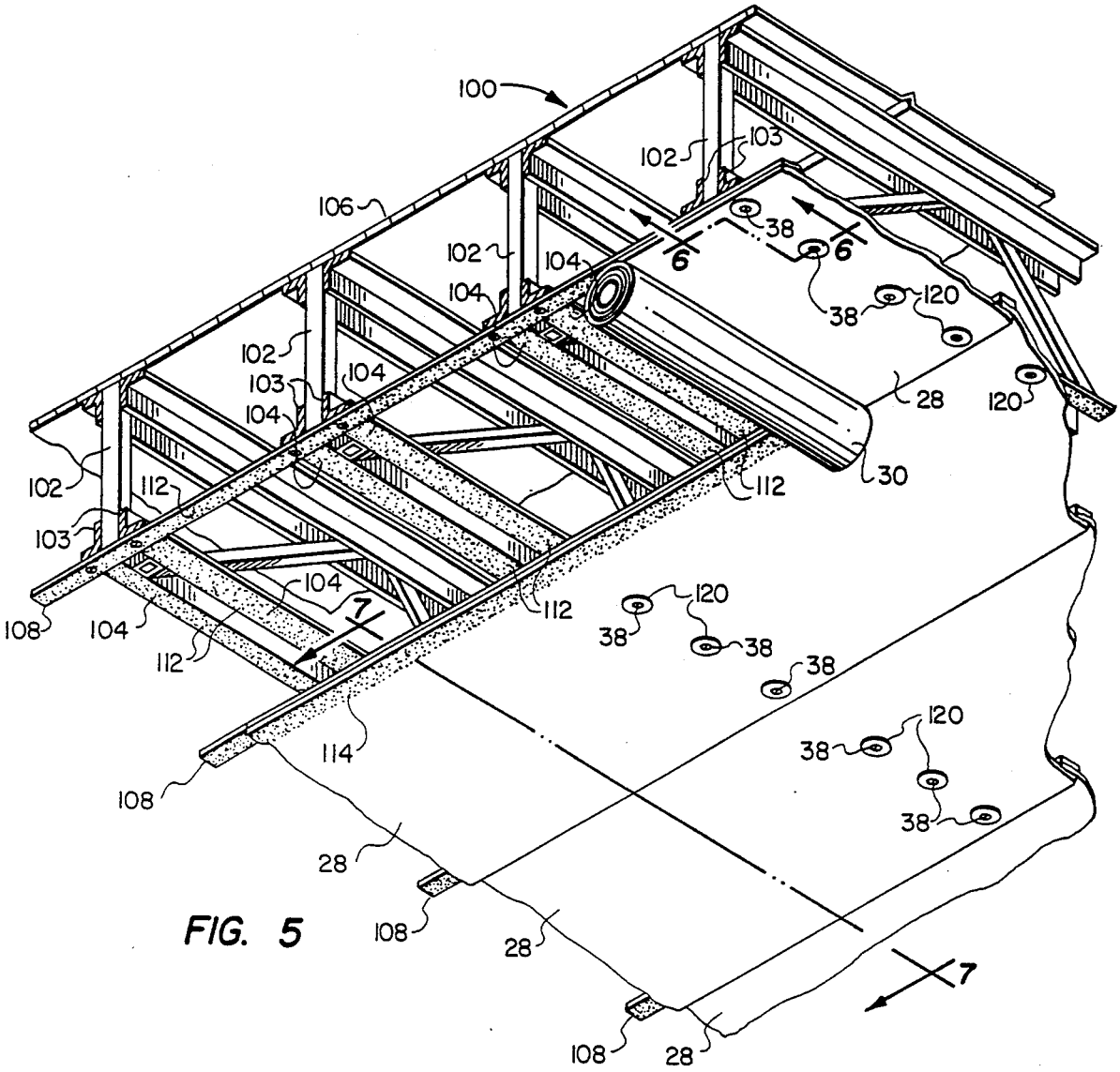
FIG. 5 is a perspective view of a portion of the ceiling covering system being installed in a building perpendicular to roof joists.
Figure 7:
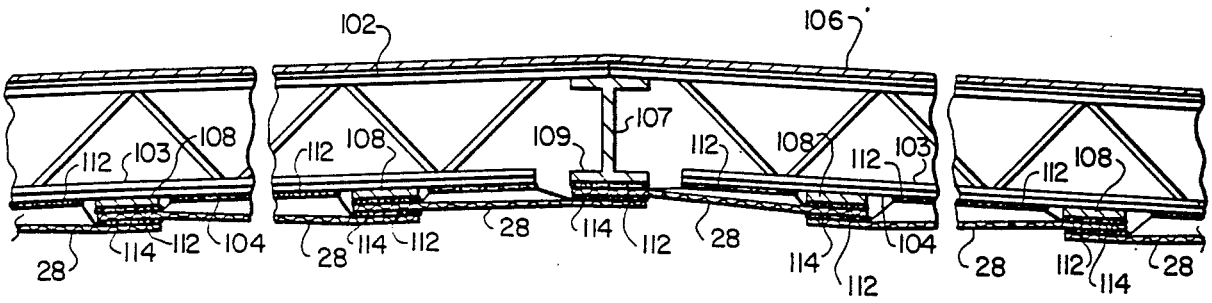
FIG. 7 is a section view taken generally along line 7—7 of FIG. 5.

Referring now to FIGS. 5, 6 and 7 an alternate embodiment of the present invention is illustrated in certain detailed respects. FIGS. 5 and 7 illustrate a portion of a roof 100 comprising a plurality of spaced apart built up type roof joists 102 having coplanar flanges 103 forming downwardly facing flange surfaces 104. The roof 100 is provided with a suitable roof deck or exterior covering 106. In the particular arrangement of the roof 100 a longitudinal ridge beam 107 extends normal to joists 102 extending from both sides of the beam 107. In certain applications of a system of the present invention it may be desirable to run the elongated panels 28 in a direction substantially normal to the longitudinal extent of the joists 102. In this regard a covering system is provided wherein a plurality of parallel spaced apart panel support strips 108 are provided as illustrated in FIGS. 5 through 7. The strips 108 are preferably secured at spaced intervals to the flanges 103 of the joists 102 by self-drilling screws 110, FIG. 6, which are preferably of the pan head or pancake head type. Alternatively, powder actuated pins or nails may be used in situations wherein the beam thickness precludes the use of self drilling threaded fasteners. The strips 108 are preferably formed of 2.0 inch to 4.0 inch width aluminum sheet of approximately 0.017 inches to 0.019 inches thickness or formed of galvanized steel in the range of 30 ga. to 25 ga. thickness. The strips 108 are preferably fastened to the joists 102 or to purlins 16 on 36.0 inch to 75.0 inch centers.

After installation of the strips 108 a layer 112 of adhesive is applied to adjacent ones of the strips and usually to the flange surfaces 104, for example, between the strips 108, as shown in FIG. 5, and a panel 28 is applied by unrolling the panel from a roll 30 in substantially the same manner as the panels 28 are applied to the purlins 16 in the embodiment of FIGS. 2 through 4. As shown in FIG. 7, a layer of adhesive 112 is applied to the underside of a strip 108 followed by application thereto of a panel 28 and then a second panel 28 is applied to the first panel in overlapping relationship with a second layer of adhesive 114 applied therebetween. Marginal edges of the panels 28 at opposite ends thereof or adjacent to vertical walls of a building may be secured in the same manner as illustrated in FIG. 4 by the addition of a support strip 50 or a similar strip member, possibly comprising one of the strips 108, if suitable structural backing is available to support the strip. Longitudinal edges of panels 28 may be secured at the ridge beam 107 to a lower flange 109, as shown in FIG. 7.

After securing the panels 28 to the strips 108 and to the flange surfaces 104 between adjacent strips self-drilling fasteners 38 may be applied at 2.0 foot to 3.0 foot intervals, as illustrated in FIG. 5, to selected ones of the flanges 103 of adjacent or alternate ones of joists 102. The fasteners 38 are each preferably used with an improved washer 120, FIG. 6, having a central recess 121 and a conical peripheral flange 122. The washers 120 are preferably formed of 24 ga. or 26 ga. steel. The strips 108 may, of course, also be used for trimming the panels 28 around openings, not shown, in the ceiling structure illustrated in FIG. 5 or around certain hanging obstructions, not shown. Those skilled in the art will appreciate that the strips 108 may also be applied to vertical walls by securing the strips to spaced apart girts such as the girts 18 or other structural members.

By providing a grid comprising the support strips 108 which are cooperable with the flanges of the structural members, 102 and 107, and securing the panels 28 with pressure sensitive adhesive and with fasteners 38, minimal deflection of the panels 28 is obtained and heavier insulation may be installed in the space between the roof deck 106 and the panels 28. All of the advantages described hereinabove for the installation of the panels 28 coextensive with the purlins 16 is provided by the system illustrated in FIGS. 5 through 7. The application of the panels 28 to the system illustrated in FIGS. 5 through 7 is similar to that described for the system illustrated in FIGS. 1 through 4 except that the installation of the panels is preceded by the installation of the panel support strips 108 at the predetermined spaced intervals extending normal to the longitudinal extent of the joists 102.

Although preferred embodiments of the present invention have been described herein in detail those skilled in the art will recognize that various substitutions and modifications may be made to the specific arrangement and method illustrated and described without departing from the scope and spirit of the invention as recited in the appended claims.

What I claim is:

1. A method for covering exposed beam ceilings and walls of a building interior having a plurality of parallel spaced apart metal beams forming a structural support for at least one of said ceiling and wall, said beams each having generally planar flange portions forming an inner distal surface and the space between said distal surface and said outer covering being adapted to be occupied by insulation material, said method comprising the sequential steps of:

applying a substantially continuous coating of liquid adhesive to a predetermined longitudinal length of the distal surface of a first adjacent pair of said beams;

applying a sheet-like panel of a flexible reinforced multilayer covering material over the previously coated distal surfaces of said first beam pair by unrolling said covering material from a supply roll source of said covering material to position said panel in an adhesive adhering relation to said beams; and repeating the previous sequential application steps of applying said liquid adhesive and said panel for other adjacent pairs of said beams.

2. The method set forth in claim 1 wherein:

said method material has a layer forming a vapor barrier between said space and the interior of said building.

3. The method system set forth in claim 1 wherein:

said covering material is applied to said flange portions by said adhesive in overlapping relationship one panel to the other.

4. The method set forth in claim 3 including:

providing spaced apart fastener means for reinforcing the attachment of said panels to said flange portions comprising self drilling threaded fastener means and providing load distributing washer means interposed between said fastener means and said panels, respectively.

5. The method set forth in claim 1 including:

forming an anchor strip secured substantially free of the support load of said beams for attaching a marginal edge of said panels extending along one of said ceiling and wall at a juncture therebetween.

6. The method set forth in claim 5 wherein:

said formed anchor strip comprises an angle section forming opposed planar surfaces for adhering a marginal edge of a ceiling panel and a marginal edge of a wall panel thereto, respectively.

7. The method set forth in claim 1 in which the step of applying said adhesive comprises applying the liquid adhesive in an aerosol form.

8. A method for covering exposed beam ceilings and walls of a building interior having a plurality of parallel spaced apart metal beams forming a structural support for at least one of said ceiling and wall, said beams each having generally planar flange portions forming an inner distal surface and the space between said distal surface and said outer covering being adapted to be occupied by insulation material, said method comprising the sequential steps of:

providing a plurality of flexible light weight flat support strips and installing said support strips parallel to each other at spaced apart intervals and secured to said beams substantially free of the support load of said beams by fasteners means with a support surface of said strips extending substantially coplanar with the distal surface place of said beams;

applying a substantially continuous coating of liquid adhesive to a predetermined longitudinal length of the support surface of adjacent ones of said support strips;

applying a sheet-like panel of a flexible reinforced multilayer covering material over the previously coated support surfaces of said support strips by unrolling said covering material from a supply source of said covering material to position said panel in an adhesive adhering relation to said support strips; and repeating the previous sequential application steps of applying said liquid adhesive and said panel for other adjacent of said support strips.

9. The method set forth in claim 8 wherein:

said panels are additionally secured to said flange portions by spaced apart fastener means.

10. The method set forth in claim 9 wherein:

said fastener means comprise self drilling threaded fasteners.

11. The method set forth in claim 8 in which said support strips comprise:

thermal insulation strip means coextensive with and secured to said flange portions and interposed between said panels and said flange portions.

12. A method for covering exposed beam ceilings and walls of a building interior having a plurality of parallel spaced apart metal beams forming a structural support for at least one of said ceiling and wall, said method comprising the steps of:

installing a plurality of parallel spaced apart support strips extending between and secured to said beams substantially coplanar with the surface plane of said beams;

applying adjacent coextensive panels of flexible sheet-like covering material to said strips along at least one marginal edge of each of said panels, respectively, and in overlapping relationship to each other along overlapped marginal edges thereof; and applying a substantially continuous coating of pressure sensitive liquid adhesive to said strips and to the marginal edge of a panel applied to a strip on the side of said marginal edge opposite said strip, respectively, so as to secure said panels to said strips and to each other in said overlapping relation to effect a substantially smooth planar covering enclosing an insulation space between said panels and an outside cover panel of one of said ceiling and said wall.

13. The method set forth in claim 12 wherein:

said beams include planar support surfaces to which said strips are secured and said panels are secured to said support surfaces at contiguous portions thereof.

14. The method set forth in claim 12 wherein:

said support strips are secured to said beams by mechanical fasteners.

15. A method for insulating and providing an interior wall covering for exposed beams of a building on at least one of the ceiling or side walls of said building, respectively, wherein said building includes a plurality of spaced apart generally parallel metal beams comprising the frame of said building, said beams each including a generally planar support surface, said method comprising the steps of:

providing a roll of flexible sheet-like covering material of sufficient width to overlap at least a portion of the support surface of adjacent ones of said beams along opposed marginal edges of said covering material;

applying a substantially continuous coating of pressure sensitive liquid adhesive to the support surfaces of adjacent ones of said beams and unrolling one panel of said covering material from a roll source of said material onto said support surfaces to cover a space formed between adjacent ones of said beams;

applying a substantially continuous coating of pressure sensitive liquid adhesive to the support surface of a beam adjacent to one beam covered by a marginal edge of said one panel of said covering material and to a surface of said one panel of covering material adjacent to said marginal edge and overlying the support surface of said one beam, and unrolling another panel of said covering material from a roll source of said material overlapping onto said marginal edge and said support surface of said adjacent beam;

repeating the steps of applying a substantially continuous coating of liquid adhesive to the support surface of a beam adjacent to the one covered by a panel of covering material and to said beam covered by a panel of covering material to cover spaces between adjacent beams so as to form an interior wall covering adapted to conceal and support insulation material in said spaces.

16. The method set forth in claim 15 including the step of:

applying self drilling fasteners to said panels of covering material at overlapped edges of said panels of covering material to secure said edges to said support surfaces, respectively.

17. A method for insulating and providing an interior wall covering for exposed metal beams of a building on at least one of the ceiling or sidewalls of said building, respectively, wherein said building includes a plurality of spaced apart generally parallel metal beams comprising the frame of said building, said beams each including a generally planar support surface, said method comprising the steps of:

providing a plurality of flexible light weight flat support strips and installing said support strips parallel to each other at spaced apart intervals extending normal to said beams and secured to said beams by fasteners means with the support surface of said strips extending substantially coplanar with the surface plane of said beams;

providing a roll of sheet-like flexible covering material of sufficient width to overlap at least a portion of a support surface formed on adjacent ones of said support strips along opposed marginal edges of said covering material;

applying a substantially continuous coating of pressure sensitive liquid adhesive to the support surfaces of adjacent ones of said support strips and unrolling one panel of said covering material onto the adhesive coating on said support surfaces to cover a portion of a space formed between adjacent ones of said beams;

applying a continuous coating of pressure sensitive liquid adhesive to the support surface of a support strip adjacent to one support strip covered by a marginal edge of said one panel of said covering material and to a surface of said one panel of covering material adjacent to said marginal edge and overlying the support surface of said one support strip, and unrolling another panel of said covering material overlapping onto the adhesive coating on said marginal edge and said support surface of said adjacent support strip;

repeating the steps of applying adhesive to the support surface of a support strip adjacent to one covered by a panel of covering material and to said one support strip covered by a panel of covering material to cover spaces between adjacent beams so as to form an interior wall covering adapted to conceal and support insulation material in said spaces.

18. The method set forth in claim 17 including the step of:

applying self drilling fasteners to said panels of covering material to secure said panels to said beams at places on said panels adjacent said beams, respectively.

19. The method set forth in claim 17 including the step of:

applying adhesive to surfaces of said beams to be contiguous with said panels and securing said panels to said beams as said panels are unrolled onto said support strips.

* * * * *

UNITED STATES PATENT AND TRADEMARK OFFICE

CERTIFICATE OF CORRECTION

PATENT NO. : 4,635,423

DATED : January 13, 1987

INVENTOR(S) : Lonnie R. Ward

It is certified that error appears in the above-identified patent and that said Letters Patent is hereby corrected as shown below:

Column 9, line 5, "method" should read -- covering --.

Column 9, line 8, after "method" delete "system".

Signed and Sealed this

Fourteenth Day of April, 1987

*Attest:*

DONALD J. QUIGG

*Attesting Officer*

*Commissioner of Patents and Trademarks*